US010179349B1

(12) United States Patent
Wang

(10) Patent No.: US 10,179,349 B1
(45) Date of Patent: Jan. 15, 2019

(54) CLEANING TOOL

(71) Applicants: Hangzhou Great Star Industrial Co., Ltd., Hangzhou (CN); Hangzhou Great Star Tools Co., Ltd., Hangzhou (CN)

(72) Inventor: Weiyi Wang, Hangzhou (CN)

(73) Assignees: Hangzhou Great Star Industrial Co., Ltd., Hangzhou (CN); Hangzhou Great Star Tools Co., Ltd., Hangzhou (CN)

( * ) Notice: Subject to any disclaimer, the term of this patent is extended or adjusted under 35 U.S.C. 154(b) by 0 days.

(21) Appl. No.: 15/724,837

(22) Filed: Oct. 4, 2017

Related U.S. Application Data

(63) Continuation of application No. PCT/CN2017/103349, filed on Sep. 26, 2017, and a continuation-in-part of application No. 15/652,575, filed on Jul. 18, 2017, now abandoned.

(30) Foreign Application Priority Data

Jul. 13, 2017 (CN) ..... 2017 1 0568462

(51) Int. Cl.

| | |
|---|---|
| ***B25G 1/00*** | (2006.01) |
| ***B08B 1/00*** | (2006.01) |
| ***B25G 1/06*** | (2006.01) |
| *B25G 3/06* | (2006.01) |

(52) U.S. Cl.
CPC ..... *B08B 1/005* (2013.01); *B25G 1/06* (2013.01); *B25G 3/06* (2013.01)

(58) Field of Classification Search
CPC ..... B25G 1/06; B08B 1/005
See application file for complete search history.

(56) References Cited

U.S. PATENT DOCUMENTS

| | | | | |
|---|---|---|---|---|
| 5,979,059 | A * | 11/1999 | Leatherman | B25F 1/04 30/161 |
| 6,257,106 | B1 * | 7/2001 | Anderson | B25F 1/003 7/129 |
| 6,408,522 | B2 * | 6/2002 | Rivera | B25F 1/003 30/155 |
| 7,249,390 | B2 * | 7/2007 | Yale | B25F 1/02 30/156 |
| 8,161,653 | B2 * | 4/2012 | Nenadic | B26B 1/04 30/155 |
| 8,561,302 | B1 | 10/2013 | Barcatta | |
| 8,707,563 | B2 * | 4/2014 | Avery | B26B 11/001 30/131 |
| 9,908,248 | B2 * | 3/2018 | Wang | B26B 11/001 |

(Continued)

FOREIGN PATENT DOCUMENTS

| | | | |
|---|---|---|---|
| CA | 2802248 | A1 | 7/2013 |
| CN | 200954083 | Y | 10/2007 |

(Continued)

*Primary Examiner* — Michael Jennings
(74) *Attorney, Agent, or Firm* — Dinsmore & Shohl LLP

(57) ABSTRACT

The present invention provides a cleaning tool comprising a tool head device and a handle portion, the tool head device comprises a cutting edge, and the handle portion is rotatably connected to the tool head device; the cutting edge is exposed outside of the handle portion in the use state; and the cutting edge is entirely or partially covered by the handle portion in the non-use state.

17 Claims, 10 Drawing Sheets

(56) References Cited

U.S. PATENT DOCUMENTS

| | | | | |
|---|---|---|---|---|
| 2004/0078980 | A1* | 4/2004 | Cheng | B26B 1/044 30/161 |
| 2005/0278956 | A1* | 12/2005 | Ling | B25F 1/04 30/161 |
| 2009/0293285 | A1* | 12/2009 | Goodrich | B25F 1/04 30/153 |
| 2012/0304472 | A1 | 12/2012 | Medhurst | |
| 2015/0328783 | A1* | 11/2015 | Wang | B25F 1/04 7/118 |

FOREIGN PATENT DOCUMENTS

| | | | |
|---|---|---|---|
| CN | 201264246 | Y | 7/2009 |
| CN | 103286795 | A | 9/2013 |
| CN | 203371562 | U | 1/2014 |
| EP | 2835235 | A1 | 2/2015 |

* cited by examiner

CLEANING TOOL

CROSS-REFERENCE TO RELATED APPLICATIONS

This application is a continuation-in-part application of U.S. patent application Ser. No. 15/652,575 which was filed on Jul. 18, 2017, and which claims priority to Chinese Patent Application No. 201710568462.7, filed on Jul. 13, 2017; this application is also a continuation of International Patent Application No. PCT/CN2017/103349, with an international filing date of Sep. 26, 2017, which also claims the benefit of Chinese Patent Application No. 201710568462.7, filed on Jul. 13, 2017. The entire content of each of these applications is incorporated herein by reference.

FIELD OF THE INVENTION

The present invention relates to a cleaning tool for cleaning the surface of an article.

DESCRIPTION OF THE PRIOR ART

Surface cleaning tools, refer to small handheld tools for cleaning attached objects such as dirt on the surface of an article, and common surface cleaning tools include a scraper, a shovel, and so on. This type of cleaning tools are generally provided with a blade having an elongated shape and having a sharp edge, and it has some degree of security risk, and is inconvenient for carrying. Some cleaning tools are provided with a blade hiding mechanism, and a protective jacket can be covered on the outside of the blade, or the blade is adjusted to the inside of the hiding mechanism, but this type of cleaning tools generally have a complicated structure and have a high production cost.

Those skilled in the art are devoted to developing a novel cleaning tool in which the blade can be shielded or hidden to reduce the risk of wounding in the non-use state, and which has a simple structure and a low production cost, and is convenient for popularization and application.

SUMMARY OF THE INVENTION

An object of the present invention is to provide a cleaning tool for solving technical problems of the prior art surface cleaning tools such as sharp edge, high security risk, and inconvenient for carrying.

In order to solve the above-mentioned technical problems, the present invention provides a cleaning tool, including a tool head device and a handle portion, the tool head device includes a cutting edge, and the handle portion is rotatably connected to the tool head device; the cutting edge is exposed outside of the handle portion in the use state; and the cutting edge is entirely or partially covered by the handle portion in the non-use state.

Further, in a different embodiment, the tool head device includes a tool post; a blade holder detachably fitted to the tool post; and a blade fixed to the blade holder; the blade includes a cutting edge.

Further, in a different embodiment, the tool post includes two oppositely disposed clips, which are respectively: a first clip, and a second clip connected to the first clip; a clip gap formed between the first clip and the second clip; the blade is provided in the upper portion of the clip gap, the cutting edge extends to the outside of the clip gap; the blade holder is provided in the middle portion of the clip gap; and a spacer provided in the lower portion of the clip gap.

Further, in a different embodiment, the tool post includes two curved sheets, which are respectively: a first curved sheet provided in the upper portion of the first clip and bent in the direction of the second clip; and a second curved sheet provided in the upper portion of the second clip and bent in the direction of the first clip.

Further, in a different embodiment, the blade includes a blade latch recess provided at the edges of both ends of the blade; the tool post includes: a bending flap protruding from the edge of one end of one of the curved sheets and snapped into the blade latch recess; and/or, a toggleable flap protruding from the edge of one end of one of the curved sheets or one of the clips and snapped into the blade latch recess; and a clip opening is formed between the toggleable flap and the curved sheet or the clip.

Further, in a different embodiment, the tool post includes: a clip slide hole penetrating through one of the clips and adjacent to the edge of one end of the clip; a spacer latch recess recessed from the side wall at one end of the spacer; and a locking member, a portion of which is provided in the lower portion of the clip gap; the locking member includes: a locking member body tangent to the spacer; a locking member slide block provided on the surface of one or both sides of the locking member body and inserted into the clip slide hole; a locking member latch block protruding from one side wall of the locking member body and snapped into the spacer latch recess; a locking member stop block protruding from the top portion of the locking member body; the side of the locking member stop block is tangent to one end of the blade holder; and a locking member push block protruding from the other side wall of the locking member body and exposed outside of the clip gap.

Further, in a different embodiment, the blade includes: a blade groove recessed from the surface of one side of the blade; or a blade throughhole penetrating through the blade; the tool post includes: a tool post latch block detachably snapped into the blade groove or the blade throughhole; the tool post latch block protruding from the surface of one curved sheet and facing toward another curved sheet.

Further, in a different embodiment, the tool post includes a first clip throughhole penetrating through the first clip; a second clip throughhole penetrating through the second clip; and a spacer throughhole penetrating through the spacer.

Further, in a different embodiment, the tool post includes a bump or a raised round face protruding from the outer surface of one of the clips and tangent to the partial surface of the handle portion.

Further, in a different embodiment, the rotation plane formed when the handle portion is rotated relative to the tool head device is the same as or parallel to the plane where the cutting edge is located.

Further, in a different embodiment, the handle portion includes a handle, the handle includes: a first clamp provided on one end of the handle; a second clamp provided on one end of the handle and disposed opposite to the first clamp; and a first handle groove provided between the first clamp and the second clamp, the tool head device is entirely or partially rotatably fitted into the first handle groove.

Further, in a different embodiment, the handle portion includes: a first clamp throughhole penetrating through one end of the first clamp; a second clamp throughhole penetrating through one end of the second clamp and disposed opposite to the first clamp throughhole; and a pin shaft successively passing through the first clamp throughhole, the first clip through ole, the spacer throughhole, the second clip throughhole and the second clamp throughhole.

Further, in a different embodiment, the handle portion includes two handles, which are respectively a first handle and a second handle; each of the handles includes: first gear teeth provided at the edge of one end of the first clamp; and second gear teeth provided at the edge of one end of the second clamp; wherein the first gear teeth of the first handle are engaged with the first gear teeth of the second handle; and the second gear teeth of the first handle are engaged with the second gear teeth of the second handle.

Further, in a different embodiment, the handle portion includes a first arcuate plate provided at the edge of one end of the first clamp; and a second arcuate plate provided at the edge of one end of the second clamp.

Further, in a different embodiment, the rotation plane formed when the handle portion is rotated relative to the tool head device is perpendicular to the plane where the cutting edge is located.

Further, in a different embodiment, the handle portion includes a pivot shaft; a first sleeve rotatably sleeved outside the pivot shaft and connected to the tool head device; and a second sleeve rotatably sleeved outside the pivot shaft and connected to one of the handles. Further, in a different embodiment, the handle portion may further include a third sleeve rotatably sleeved outside the pivot shaft and connected to the other handle.

Further, in a different embodiment, the handle portion includes two handle throughholes penetrating through the handle, which are respectively on both sides of the pivot shaft; and a bolt for fixing the tool head device and the handle portion; the bolt successively passes through the handle throughhole, the second clip throughhole, the spacer throughhole and the first clip throughhole in the use state; and the bolt successively passes through the handle throughhole, the first clip throughhole, the spacer throughhole, and the second clip throughhole in the non-use state.

Further, in a different embodiment, the handle portion includes two handles, which are respectively a first handle and a second handle; the handle portion further includes: a second handle groove penetrating through the distal end of the first handle; a third handle groove penetrating through the distal end of the second handle and being on the same straight line as the second handle groove; a catch spindle having two ends vertically connected to two inner side walls of the second handle groove, respectively; a locking opening penetrating through the side wall on one side of the third handle groove; and a handle catch having one end hinged to the catch spindle and the other end provided with a locking post; when the first handle and the second handle are brought into contact with each other, the locking post is snapped into the locking opening.

Further, in a different embodiment, the handle portion includes a resilient latch sheet which is fixed within the second handle; the resilient latch sheet includes a resilient bayonet corresponding to the locking opening; when the first handle and the second handle are brought into contact with each other, the locking post is snapped into the resilient bayonet.

The benefit of the present invention is to provide a cleaning tool in which the blade can be effectively hidden to reduce the risk of wounding in the non-use state so as to make it convenient for carrying; and the cleaning tool has a simple structure and a low production cost, and is simple to operate, easy to use, and convenient for popularization and application in the market.

Figure 1:
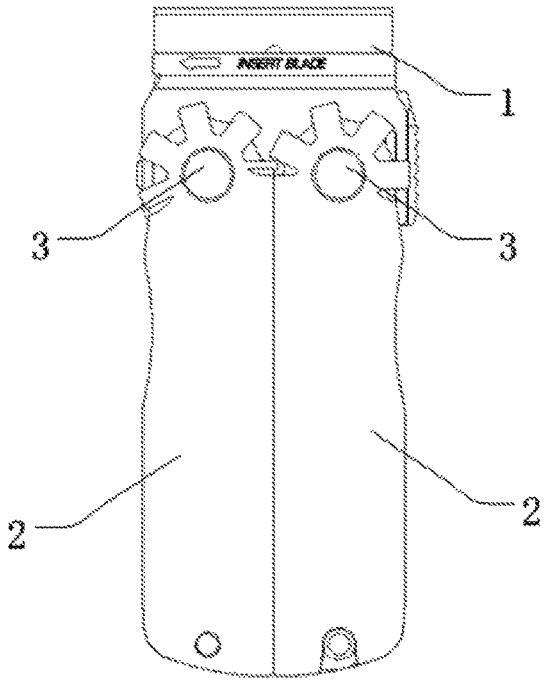
FIG. 1 is an overall structural schematic view of Embodiment 1 of the present invention in the use state.

The component reference numerals in the figures are as follows:

1 tool head device, 2 handle portion, 3 pin shaft;

11 tool post, 12 blade holder, 13 blade;

21 first handle, 22 second handle, 23 second handle groove, 24 third handle groove;

25 locking opening, 26 handle catch, 27 locking post, 28 resilient latch sheet;

31 female rivet, 32 male rivet; 41 toggleable flap, 42 clip opening;

51 third handle, 52 pivot shaft, 53 first sleeve, 54 second sleeve;

55 first receiving space, 56 handle throughhole, 57 handle throughhole, 58 bolt;

61 fourth handle, 62 fifth handle, 63 pivot shaft, 64 first sleeve, 65 second sleeve;

66 third sleeve; 67 second receiving space, 68 second receiving space;

110 bump, 111 first clip, 112 second clip, 113 clip gap, 114 spacer;

115 bending flap; 116 pin, 117 clip slide hole, 118 locking member, 119 bent portion;

120 raised round face, 281 resilient bayonet; 1111 first curved sheet, 1112 first clip throughhole;

131 cutting edge, 132 blade latch recess, 133 blade groove;

211 first clamp, 212 second clamp, 213 first handle groove;

1121 second curved sheet, 1122 second clip throughhole;

1141 spacer latch block, 1142 spacer latch recess, 1143 spacer throughhole;

1181 locking member body, 1182 locking member slide block, 1183 locking member latch block, 1184 locking member stop block;

1185 locking member push block;

2111 first clamp throughhole, 2112 first gear teeth, 2113 first arcuate plate;

2121 second clamp throughhole, 2122 second gear teeth.

DETAILED DESCRIPTION OF THE PREFERRED EMBODIMENTS

The preferred embodiments of the present invention will be described fully hereinafter with reference to the accompanying drawings of the description, so that the technical contents thereof will be more clearly and easily understood. The present invention may be embodied in many different forms of embodiments, and the scope of which is not limited to the embodiments mentioned herein.

In the drawings, the components having the same structures are denoted by the same reference numerals, and the components having similar structures or functions are denoted by the similar reference numerals. The dimension and thickness of each of the components shown in the drawings are shown arbitrarily, and the present invention does not limit the dimension and thickness of each of the components. In order to make the illustration clearer, the thickness of the component is appropriately exaggerated in some places in the drawings.

The directional words mentioned in the present invention, such as upper, lower, front, back, left, right, inner, outer, side, top, bottom, top end, bottom end, distal end, etc., are only the directions in the drawings and are only intended to explain and illustrate the present invention, but not to limit the scope of protection of the present invention.

When a certain component is described as being "on" another component, the component may be placed directly on another component; an intermediate component may also be present, the component is placed on the intermediate component, and the intermediate component is placed on another component. When a component is described as being "mounted to" or "connected to" another component, the two may be understood to be directly "mounted" or "connected", or one component is indirectly "mounted to" or "connected to" another component via an intermediate component.

Embodiment 1

Figure 2:
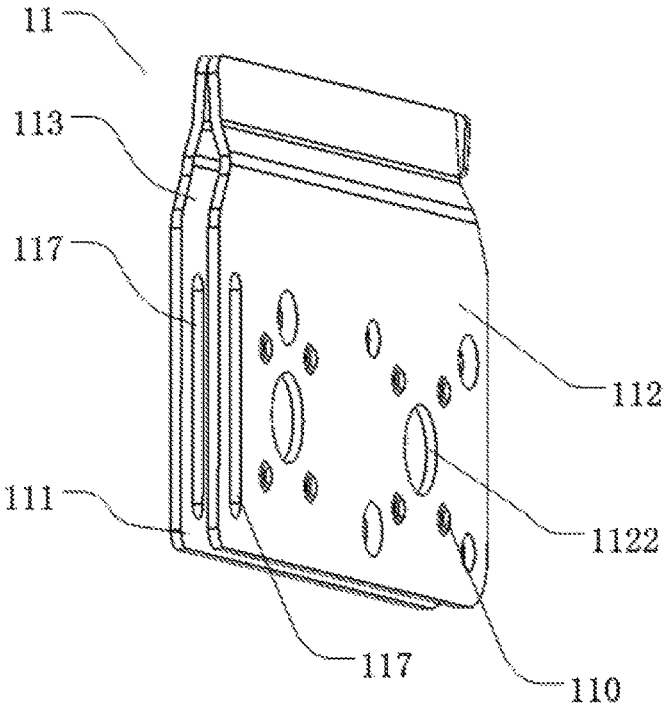
FIG. 2 is a structural schematic view of a tool post according to Embodiment 1 of the present invention.
Figure 3:
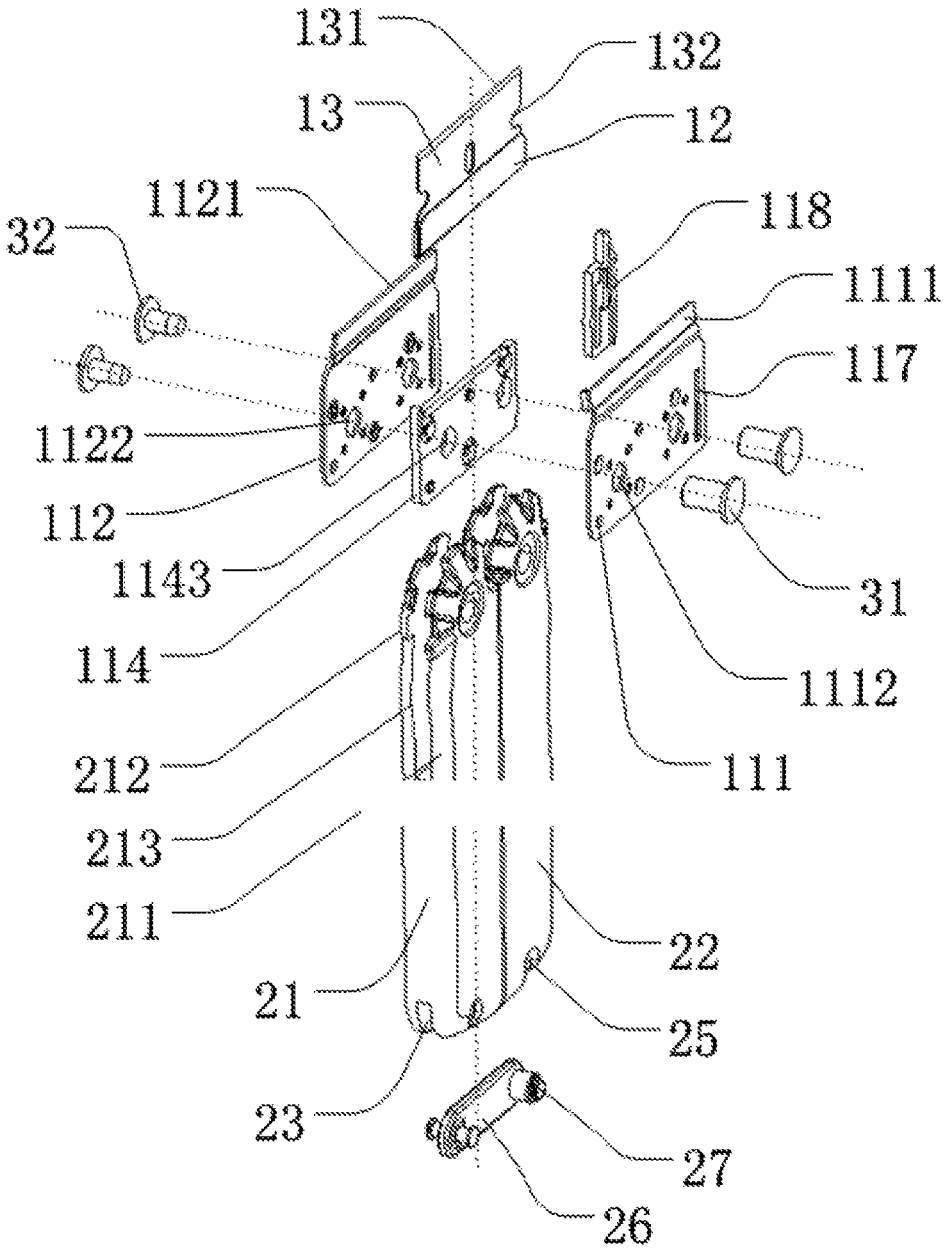
FIG. 3 is an exploded structural schematic view of Embodiment 1 of the present invention in the use state.

As shown in FIGS. 1 to 3, this embodiment provides a cleaning tool including a tool head device 1 and a handle portion 2. The tool head device 1 includes a cutting edge 131; and the handle portion 2 is rotatably connected to the tool head device 1; the cutting edge 131 is exposed outside of the handle portion 2 in the use state; and the cutting edge 131 is entirely or partially covered by the handle portion 2 in the non-use state.

The tool head device 1 includes a tool post 11, a blade holder 12 and a blade 13, the blade holder 12 is detachably fitted to the tool post 11; and the blade 13 is fixed to the blade holder 12; the blade 13 includes a cutting edge 131.

The tool post 11 includes two oppositely disposed clips, which are respectively a first clip 111 and a second clip 112, the tool post 11 further includes a clip gap 113 and a spacer 114, the second clip 112 and the first clip 111 are connected with each other; and the clip gap 113 is formed between the first clip 111 and the second clip 112.

The lower portion of the clip gap 113 has a maximum width for mounting the spacer 114; the middle portion of the clip gap 113 is gradually narrowed from bottom to top, and the middle portion thereof is used for mounting the blade holder 12. The upper portion of the clip gap 113 has a minimum width for mounting the blade 13, the lower half portion of the blade is provided in the upper portion of the clip gap 113, and the cutting edge thereof extends to the outside of the clip gap 113. One or both ends of the top portion of the spacer 114 are provided with a spacer latch block 1141 which is tangent to one or both ends of the blade holder 12, and the blade holder 12 is positioned above the spacer 114. In this embodiment, one spacer latch block 1141 is preferred, which is tangent to one end of the blade holder 12, and the other end of the blade holder 12 is tangent to the locking member 115.

The blade 13 includes a blade latch recess 132 provided at the edge of both ends of the blade 13, preferably provided in the middle portion thereof. The tool post 11 includes two curved sheets, which are respectively a first curved sheet 1111 and a second curved sheet 1121. The first curved sheet 1111 is a portion of the first clip 111 and is provided in the upper portion of the first clip 111 and is bent in the direction of the second clip 112; the second curved sheet 1121 is a portion of the second clip 112 and is provided in the upper portion of the second clip 112 and is bent in the direction of the first clip 111, so that the middle portion of the clip gap 113 is gradually narrowed from bottom to top.

Figure 4:
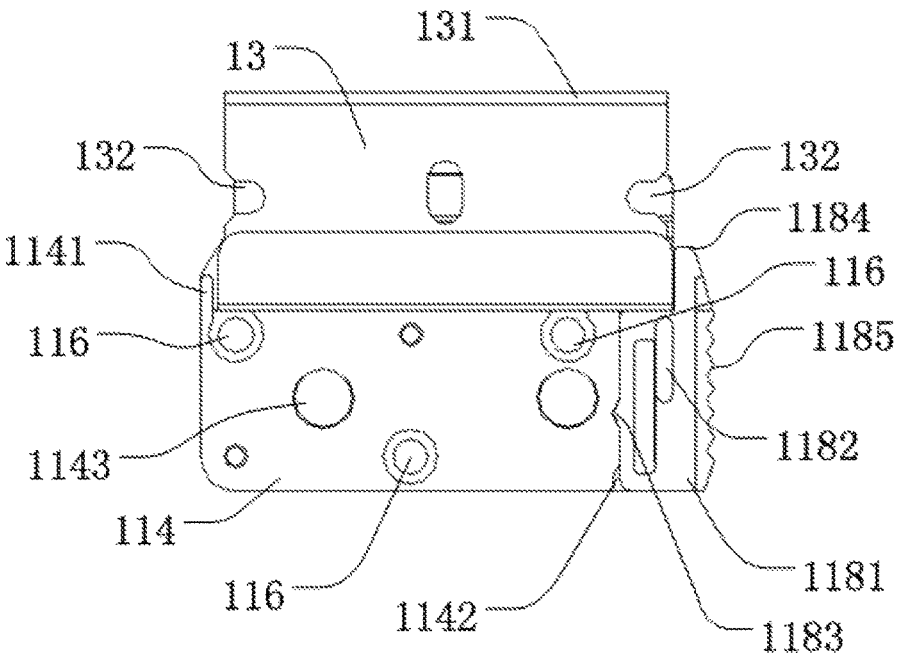
FIG. 4 is a structural schematic view of the locking member in the locked state according to Embodiment 1 of the present invention.

As shown in FIG. 4, the tool post 11 includes three sets of pins 116, which successively pass through the first clip 111, the spacer 114 and the second clip 112 to fix the three as a whole. The three sets of pins 116 are divided into three sets, there are two sets in the upper portion, which are located in the upper left corner and the upper right corner of the figure, respectively, and there is one set in the middle of the lower portion, the three enclose a triangular shape so that the two clips 111, 112 and the spacer 114 can be stably fixed as a whole.

The tool post 11 includes a bending flap 115 protruding from the edge of one side of the first curved sheet 1111 and/or the second curved sheet 1121 and snapped into the blade latch recess 132 to prevent the blade 13 from slipping off. In this embodiment, the bending flap 115 is preferably provided at the edge of left side of the first curved sheet 1111 and is perpendicular to the first curved sheet 1111.

The tool post 11 includes a clip slide hole 117, a spacer latch recess 1142, and a locking member 118. The clip slide hole 117 penetrates through the first clip 111 and the second clip 112 and is adjacent to the edge of one end of the first clip 111 and the second clip 112.

Figure 5:
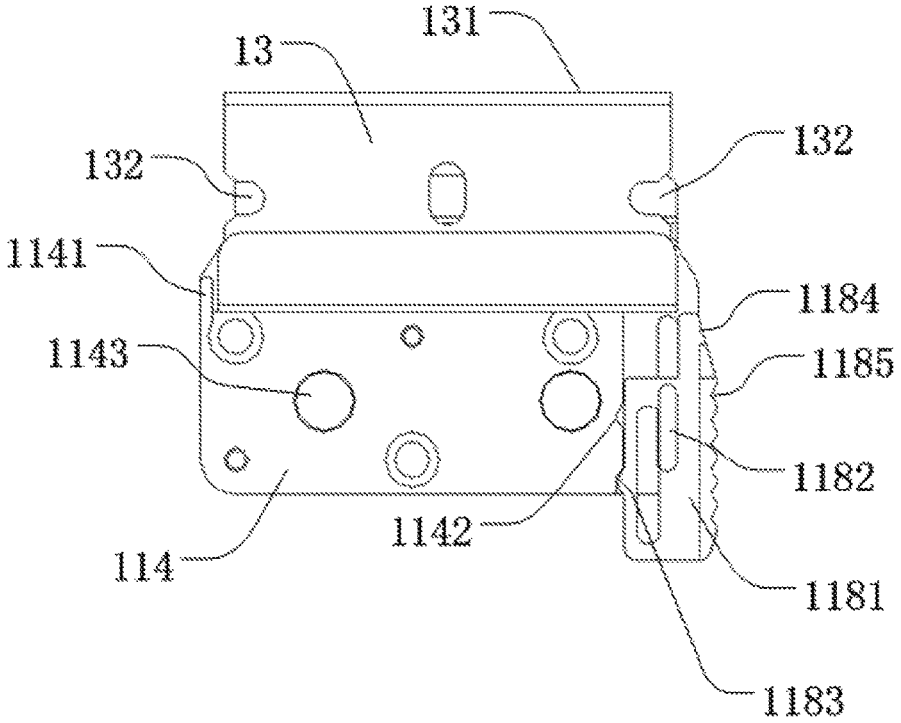
FIG. 5 is a structural schematic view of the locking member in the unlocked state according to Embodiment 1 of the present invention.

As shown in FIGS. 4 to 5, the locking member 118 has one portion provided in the lower portion of the clip gap 113 and the other portion exposed outside of the clip gap 113; and the locking member 118 includes a locking member body 1181, a locking member slide block 1182, a locking member latch block 1183, a locking member stop block 1184, and a locking member push block 1185. The locking member body 1181 is tangent to the spacer 114; there are two spacer latch recesses 1142, which are recessed from the side wall of one end of the spacer 114 and are respectively provided in the middle portion and lower portion of the spacer 114. The locking member latch block 1183 protrudes from one side wall of the locking member body 1181 and is snapped into the spacer latch recess 1142 in the middle portion of the spacer 114; the recess opening direction of the spacer latch recess 1142 faces toward the locking member 118. The locking member slide block 1182 is provided on the surface of both sides of the locking member body 1181 and is inserted into the clip slide hole 117 so as to be slidable within the clip slide hole 117. The locking member stop block 1184 protrudes from the top portion of the locking member body 1181; the side of the locking member stop block 1184 is tangent to one end of the blade holder 12 for holding the blade holder 12 to prevent the blade 13 from slipping out. The locking member push block 1185 protrudes from the other side wall of the locking member body 118 and is exposed outside of the clip gap 113 to facilitate the user to push the locking member 118 with his/her finger. When the locking member 118 is pushed to slide down, the locking member latch block 1183 slides out of the spacer latch recess 1142 in the middle portion of the spacer 114 and slides into the spacer latch recess 1142 in the lower portion of the spacer 114, and the locking member stop block 1184 is disengaged from the blade holder 12 so that the blade holder 12 and the blade 13 can be removed therefrom, and the blade 13 can be replaced.

As shown in FIG. 2, the tool post 11 includes a first clip throughhole 1112, a second clip throughhole 1122, and a spacer throughhole 1143. The first clip throughhole 1112 penetrates through the first clip 111; the second clip throughhole 1122 penetrates through the second clip 112; the spacer throughhole 1143 penetrates through the spacer 114. The first clip throughhole 1112, the second clip throughhole 1122, and the spacer throughhole 1143 have the same size and the hole axes of the three are located on the same straight line.

In this embodiment, the rotation plane formed when the handle portion 2 is rotated relative to the tool head device 1 is the same as or parallel to the plane where the cutting edge 131 (also, i.e., the blade 13) is located.

In this embodiment, the handle portion 2 includes two handles, which are respectively a first handle 21 and a second handle 22. The first handle 21 is similar to the second handle 22 in structure, and the first handle 21 is taken as an example hereinafter.

The first handle 21 includes a first clamp 211, a second clamp 212, and a first handle groove 213. The first clamp 211 is provided at one end of the handle 21; the second clamp 212 is provided at one end of the handle 21 and is disposed opposite to the first clamp; the first handle groove 213 is provided between the first clamp 211 and the second clamp 212, and the depth of the first handle groove 213 is greater than the height of the tool head device 1, and the tool head device 1 is entirely or partially rotatably fitted into the first handle groove 213; the outer surface of the tool post 11, i.e., the outer surfaces of the first clip 111 and the second clip 112, is tangent to the inner sides of the first clip 211 and the second clip 212; during the relative rotation of the tool head device 1 and the handle portion 2, the contact area between the above tangent planes is relatively large, the friction is also relatively large, and the rotation process is laborious. The tool post 11 may further include a bump 110 or a small spacer (not shown), the bump 110 protrudes from the outer surface of the first clip 111 and/or the second clip 112 and is tangent to the surface of the handle portion 2, specifically, it is tangent to the inner sides of the first clamp 211 and the second clamp 212; it is possible to effectively reduce the contact area between the two adjacent surfaces, thereby reducing the friction coefficient so that the rotation process is more effortless. In this embodiment, the bump 110 is located around the spacer throughhole 1143, the small spacer is provided between the first clip 111 and/or the second clip 112 and the handle portion 1, which also reduces the contact area between the two adjacent surfaces, thereby reducing the friction coefficient so that the rotation process is more effortless.

Figure 6:
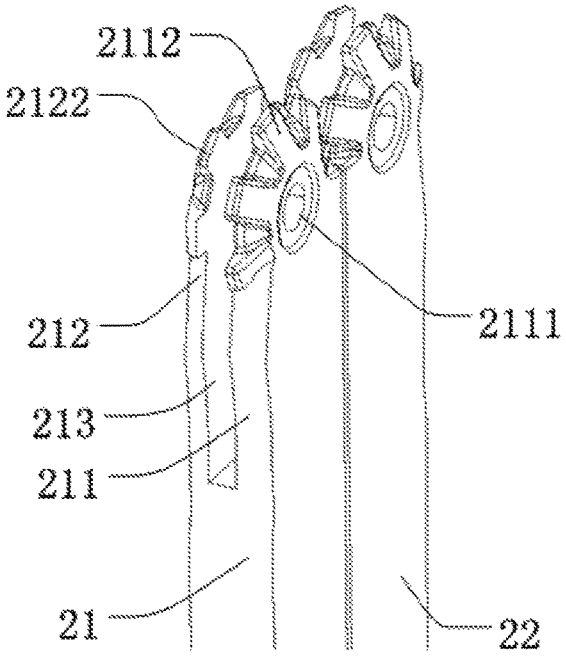
FIG. 6 is a structural schematic view of the handle according to Embodiment 1 of the present invention.

As shown in FIG. 6, the first handle 21 includes a first clamp throughhole 2111, a second clamp throughhole 2121, and a pin shaft 3. The first clamp throughhole 2111 penetrates through one end of the first clamp 211, and the second clamp throughhole 2121 penetrates through one end of the second clamp 212 and is disposed opposite to the first clamp throughhole 2111. The pin shaft 3 successively passes through the first clamp throughhole 2111, the first clip throughhole 1112, the spacer throughhole 1143, the second clip throughhole 1122, and the second clamp throughhole 2121. The pin shaft 3 is made up of a pair of female and male rivets which are connected to each other, and the female rivet 31 is provided with a rivet groove (not shown), and the male rivet 32 is inserted and fixedly mounted to the rivet groove.

As shown in FIG. 6, the first handle 21 further includes first gear teeth 2112 and second gear teeth 2122. The first gear teeth 2112 are provided at the edge of one end of the first clamp 211; and the second gear teeth 2122 are provided at the edge of one end of the second clamp 212 and have the same or similar shape as the first gear teeth 2122.

Figure 7:
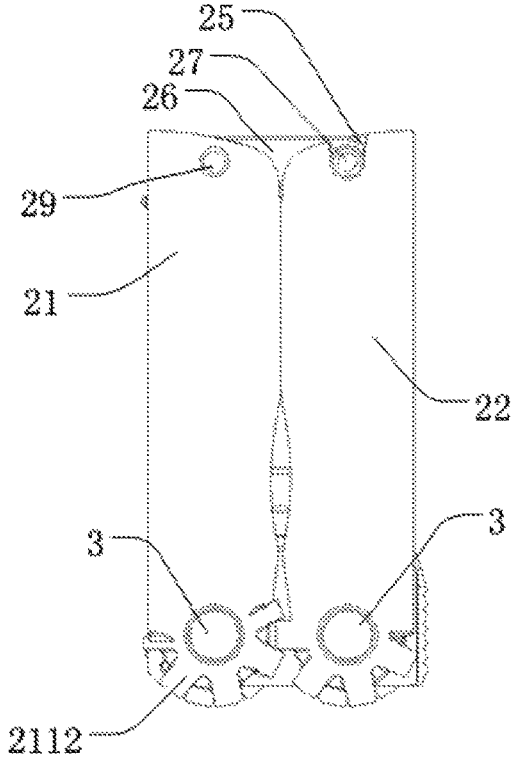
FIG. 7 is an overall structural schematic view of Embodiment 1 of the present invention in the non-use state.

The second handle 22 is similar in structure to the first handle 21, and the first gear teeth of the first handle 21 are engaged with the first gear teeth of the second handle 22; and the second gear teeth of the first handle 21 are engaged with the second gear teeth of the second handle 22. When the two handles are opened from the closed state, each of the handles can be rotated 180 degrees about the pin shaft 3, the first handle 21 and the second handle 22 are rotated in opposite directions so that the two handles are closed again; the second handle 22 and the first handle 21 on the left and right sides are rotated synchronously since the edges thereof are engaged. Similarly, when the two handles are closed from the use state, the two handles are also rotated 180 degrees around the pin shaft 3, see FIG. 7.

Figure 8:
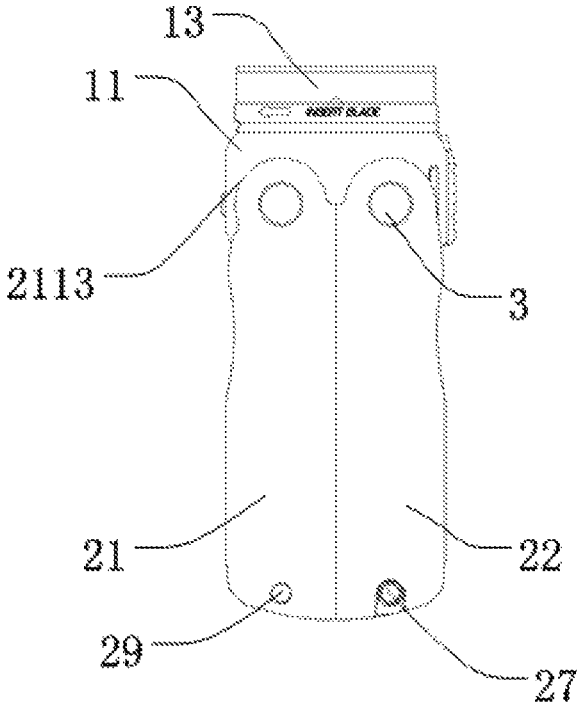
FIG. 8 is a structural schematic view of a variant embodiment of Embodiment 1 of the present invention.

As shown in FIG. 8, in another embodiment of the present invention, the handle of the handle portion 2 does not include the first gear teeth 2112 and the second gear teeth 2122, but includes a first arcuate plate 2113 and a second arcuate plate (not shown). The first arcuate plate 2113 is provided at the edge of one end of the first clamp 211, and the second arcuate plate is provided at the edge of one end of the second clamp 212. In this embodiment, the second handle 22 is similar in structure to the first handle 21, but they cannot be rotated synchronously, and the two handles are opened or closed, respectively.

Figure 9:
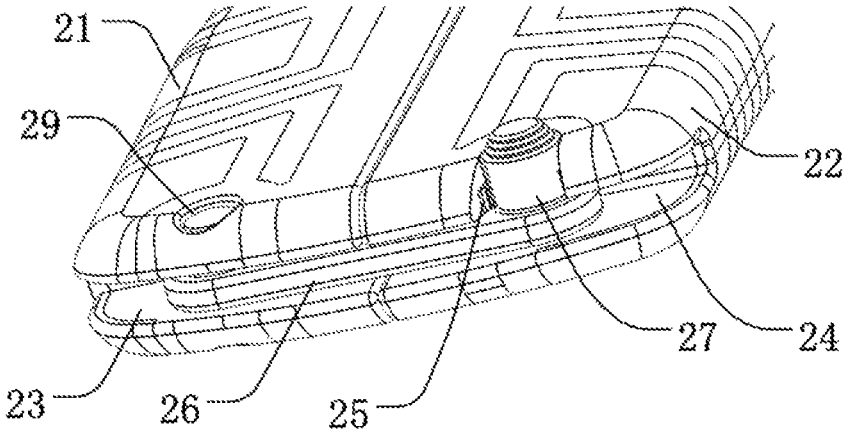
FIG. 9 is a structural schematic view of the components of the handle portion according to Embodiment 1 of the present invention.

As shown in FIG. 9, the handle portion 2 further includes a handle latching structure, which is provided at the ends of the two handles and includes a second handle groove 23, a third handle groove 24, a catch spindle 29, a locking opening 25 and a handle catch 26. The second handle groove 23 penetrates through the distal end of the first handle 21, and the third handle groove 24 penetrates through the distal end of the second handle 22 and is located on the same straight line as the second handle groove 23. The two ends of the catch spindle 29 are vertically connected to the two inner side walls of the second handle groove 23, respectively; the locking opening 25 penetrates through the side wall of one side of the third handle groove 24; and one end of the handle catch 26 is hinged to the catch spindle 29, and the other end thereof is provided with a locking post 27 which is provided in parallel with the catch spindle 29. The locking post 27 is snapped into the locking opening 25 when the first handle 21 and the second handle 22 are closed, regardless of whether this embodiment is in the operating or non-operating state. The inner wall at the opening of the locking opening 25 is provided with a snapping component having certain elasticity which is two oppositely disposed opening projections so that the locking post 27 is allowed to enter the locking opening 25 so as to be caught by the opening projections. In the case that the user needs to use a relatively large force to remove the locking post 27 from the locking opening 25, the two handles will not be separated by unintentional collisions, thereby effectively reducing the security risk.

Figure 10:
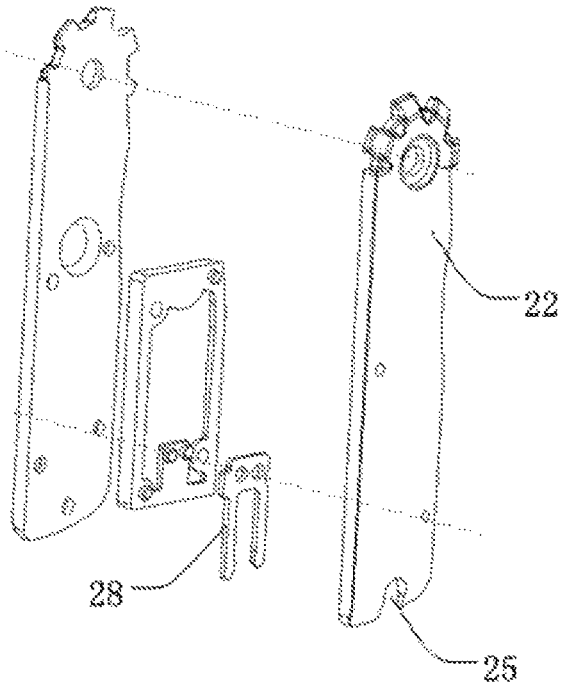
FIG. 10 is a structural schematic view of another variant embodiment of Embodiment 1 of the present invention.

As shown in FIG. 10, this embodiment requires a high level of handle material, and if the elasticity of the handle material is poor, the locking post 27 of the handle catch 26 may be difficult to enter the locking opening 25, and therefore, it is necessary to increase the bayonets made of the elastic material. In another embodiment of the present invention, the handle portion 2 further includes a resilient latch sheet 28 which is fixed within the second handle 22; the resilient latch sheet 28 includes a resilient bayonet corresponding to the locking opening 25, the snapping component at the front end of the resilient bayonet includes two oppositely disposed opening projections; the locking post 27 slides into the locking opening 25 and is snapped into the resilient bayonet when the first handle 21 and the second handle 22 are closed, regardless of whether this embodiment is in the operating or non-operating state.

This embodiment provides a cleaning tool in which the blade can be effectively hidden to reduce the risk of wounding in the non-use state so as to make it convenient for carrying; and, the cleaning tool has a simple structure and a low production cost, and is simple to operate, easy to use, and convenient for popularization and application in the market.

Embodiment 2

Figure 11:
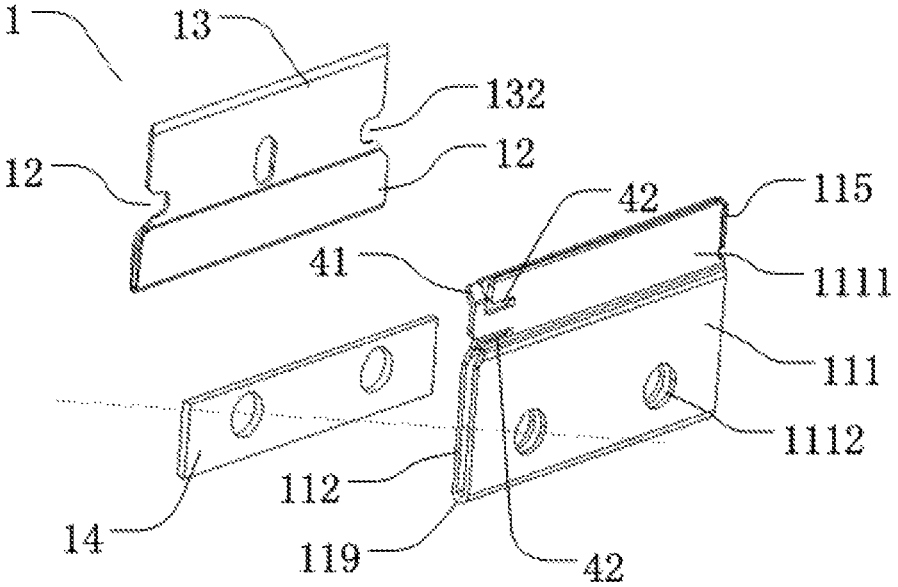
FIG. 11 is an exploded structural schematic view of the tool head device according to Embodiment 2 of the present invention.

As shown in FIG. 11, the technical features of Embodiment 2 are largely the same as those of Embodiment 1, and the distinguishing technical feature between them is in that the locking member is not included in Embodiment 2, but the toggleable flap 41 and the clip opening 42 are included therein. The toggleable flap 41 protrudes from the edge of one end of one curved sheet 1111/1121 and is snapped into the blade latch recess 132; and the clip opening 42 is formed between the toggleable flap 41 and the curved sheet 1111/1121.

In this embodiment, the toggleable flap 41 protrudes from the edge of one side of the first curved sheet 1111; and the clip opening 42 is formed between the toggleable flap 41 and the first clip 111. The toggleable flap 41 is snapped into the blade latch recess 132 to ensure that the blade 13 will not slide off therefrom; a bending flap 115 is provided at the edge of the other side of the first curved sheet 1111 or the second curved sheet 1121 to ensure that the blade 13 will not slide off therefrom. The presence of the clip opening 42 makes it possible for the toggleable flap 41 to undergo a relatively large deformation so that the blade 13 can be removed and the blade 13 can be replaced. In this embodiment, two clip openings 42 are preferred, which are respectively provided on both sides of the toggleable flap 41 so as to perform a toggle operation. In other embodiments, the toggleable flap 41 may also protrude from the edge of one side of the second curved sheet 1121; the clip opening 42 is formed between the toggleable flap 41 and the second clip 112.

Another distinguishing technical feature between Embodiment 2 and Embodiment 1 is that the first clip 111 and the second clip 112 are not fixedly connected by the pin 116, but the two clips 111, 112 are provided as an integrated structure. The tool post 11 includes a bent portion 119 connected to the bottom portions of the first clip 111 and the second clip 112, respectively; the first clip 111, the bent portion 119 and the second clip 112 are an integrated structure.

Other technical features of Embodiment 2 are the same as those of Embodiment 1, and will not be described here.

Embodiment 3

Figure 12:
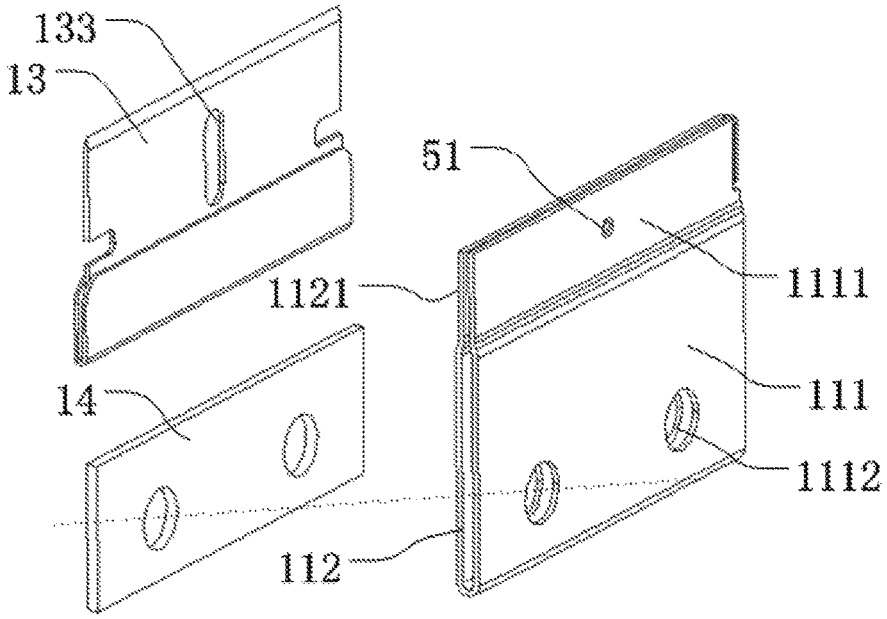
FIG. 12 is an exploded structural schematic view of the tool head device according to Embodiment 3 of the present invention.

As shown in FIG. 12, the technical features of Embodiment 3 are largely the same as those of Embodiment 1, and the distinguishing technical feature between them is in that the locking member 118 is not included in Embodiment 3, but the following scheme is included therein.

The blade 13 includes a blade groove 133 which is recessed from the surface of one side of the blade 13; in other embodiments, the blade 13 may further include a blade throughhole penetrating through the middle portion of the blade 13.

The tool post 11 includes a tool post latch block 51 which is detachably snapped into the blade groove 133 or the blade throughhole; the tool post latch block 51 protrudes from the surface of the first curved sheet 1111 and faces toward the second curved sheet 1121. In other embodiments, the tool post 11 may further include two tool post latch blocks 51, one tool post latch block 51 protrudes from the surface of the first curved sheet 1111 and faces toward the second curved sheet 1121; and the other tool post latch block 51 protrudes from the surface of the second curved sheet 1121 and faces toward the first curved sheet 1111.

In the normal use state of this embodiment, the tool post latch block 51 is snapped into the blade groove 133 or the blade throughhole so that the blade 13 can be fixed. When the user needs to replace the blade, an upward push force or pull force can be applied directly onto the blade so that the tool post latch block 51 is disengaged from the blade groove 133 or the blade throughhole, so that the blade holder 12 and the blade 13 are pushed out, and then the blade can be replaced.

The other technical features of Embodiment 3 are the same as those of Embodiment 1 and will not be described here.

Embodiment 4

Figure 13:
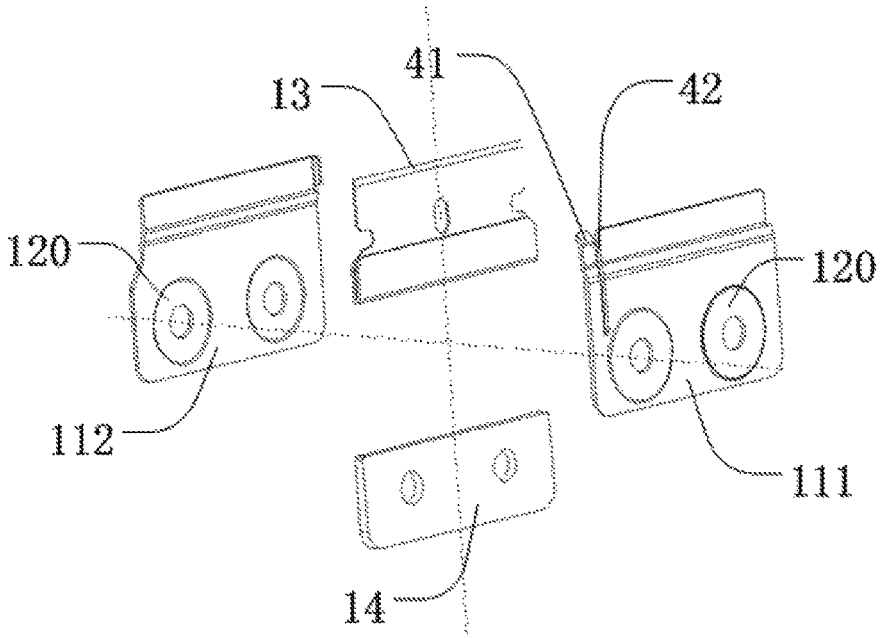
FIG. 13 is an exploded structural schematic view of the tool head device according to Embodiment 4 of the present invention.

As shown in FIG. 13, the technical features of Embodiment 4 are largely the same as those of Embodiment 1, and the distinguishing technical feature between them is in that the tool post 11 includes a raised round face 120 which is annular and provided around the first clip throughhole 1112 or the second clip throughhole 1122; the raised round face 120 protrudes from the outer surface of the first clip 111 and/or the second clip 112 and is tangent to the surface of the handle portion 2, and specifically, is tangent to the inner sides of the first clamp 211 and the second clamp 212; which can effectively reduce the contact area between the two adjacent surfaces, thereby reducing the friction coefficient and making the rotation process more effortless.

Another distinguishing technical feature between Embodiment 4 and Embodiment 1 is in that the locking member 118 is not included in Embodiment 4, but the toggleable flap 41 and the clip opening 42 are included therein.

The toggleable flap 41 protrudes from the edge of one end of one clip 111/112 and is snapped into the blade latch recess 132; a clip opening 42 is formed between the toggleable flap 41 and the clip 111/112. In this embodiment, the toggleable flap 118 protrudes from the edge of one side of the first clip 111; and the clip opening 42 is formed between the toggleable flap 41 and the first clip 111. In this embodiment, the togglable flap 41 is snapped into the blade latch recess 132, and a bending flap 115 is provided at the edge of the other side of the first clip 111 for fixing the blade 13, ensuing that the blade 13 will not slide off. The presence of the clip opening 42 makes it possible for the toggleable flap 41 to undergo a relatively large deformation so that the blade 13 can be removed and the blade 13 can be replaced. In this embodiment, one clip opening 42 is preferred, which is provided on one side of the toggleable flap 41, and the other side of the toggleable flap 41 is vacant for the toggle operation. In other embodiments, the toggleable flap 118 may also protrude from the edge of one side of the second clip 112; the clip opening 42 is formed between the toggleable flap 41 and the second clip 112.

Other technical features of Embodiment 4 are the same as those of Embodiment 1, and will not be described here.

Embodiment 5

Figure 14:
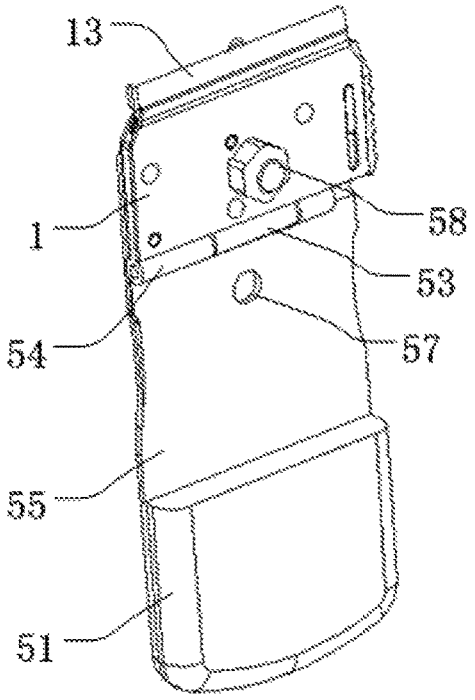
FIG. 14 is an overall structural schematic view of Embodiment 5 of the present invention in the use state.
Figure 15:
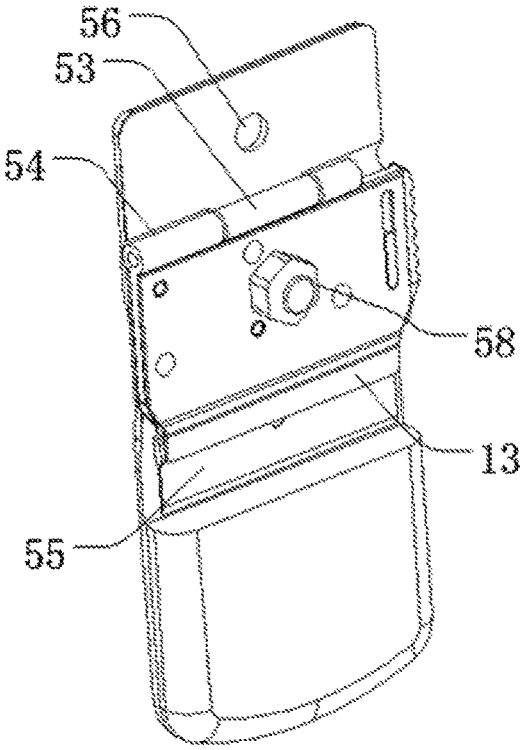
FIG. 15 is an overall structural schematic view of Embodiment 5 of the present invention in the non-use state.
Figure 16:
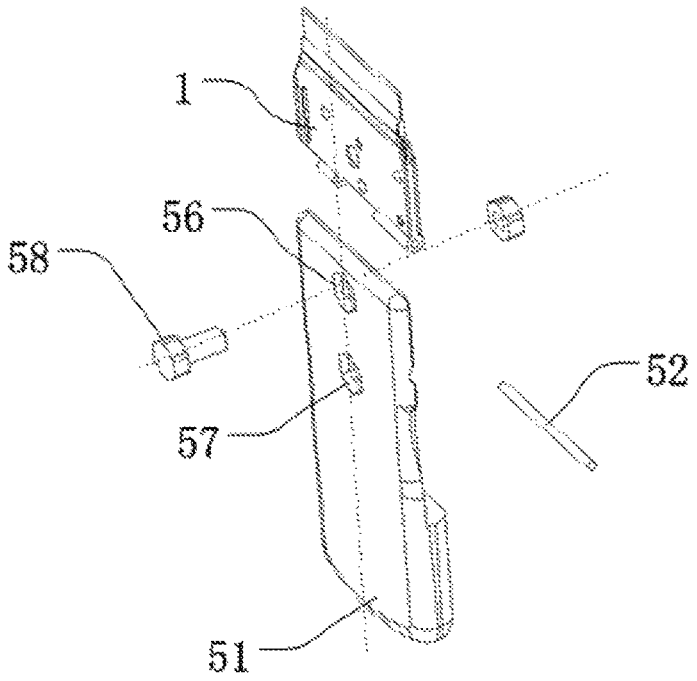
FIG. 16 is an exploded structural schematic view of Embodiment 5 of the present invention.

As shown in FIGS. 14 to 16, the technical features of Embodiment 5 are largely the same as those of Embodiment 1. and the distinguishing technical feature between them is in that, in Embodiment 5, the rotation plane formed when handle portion 2 is rotated relative to the tool head device 1 is perpendicular to the plane where the cutting edge 131 (blade 13) is located.

The handle portion 11 includes a third handle 51, a pivot shaft 52, a first sleeve 53, and a second sleeve 54.

In this embodiment, one end of the third handle 51 is provided with a first receiving space 55, and the bottom of the first receiving space 55 is a sunken plane whose side wall is a portion of the third handle 51. The pivot shaft 52 is provided within the first receiving space 55. The first sleeve 53 is rotatably sleeved outside the pivot shaft 52 and is connected to the tool head device 1, and specifically, the first sleeve 53 is provided at the edge of the spacer 114 in the tool post 11. The second sleeve 54 is rotatably sleeved outside the pivot shaft 52 and is connected to the third handle 51; the second sleeve 54 and the first sleeve 53 can be relatively rotated by the pivot shaft 52.

The handle portion 11 includes two handle throughholes 56, 57 and a bolt 58. The two handle throughholes 56, 57 penetrate through the third handle 51, and specifically, penetrate through the sunken plane of the first receiving space 55, are located on both sides of the pivot shaft 52, respectively. The bolt 58 is used for fixing the tool head device 1 and the handle portion 2, and specifically, is used for fixing the tool post 11 and the third handle 51.

In the use state, the user aligns a set of throughholes on the tool post 11 with the handle throughholes 56 on the outside, the tool post 11 are partially received within the first receiving space 55, the cutting edge 131 of the blade 13 is exposed outside of the third handle 51, the bolt 58 successively passes through the handle throughhole 56, the second clip throughhole 1122, the spacer throughhole 1143, and the first clip throughhole 1112. In the non-use state, the user removes the bolt and rotates the tool post 11 by 180 degrees, and the tool post 11 is integrally received within the first receiving space 55, and the cutting edge 131 of the blade 13 faces toward the side wall of the first receiving space 55; a set of throughholes on the tool post 11 are aligned with the handle throughholes 57 on the inside, and then the bolts 58 are successively passed through the handle throughhole 57, the first clip throughhole 1112, the spacer throughhole 1143, and the second clip throughhole 1122, and it is then fixed.

Other technical features of Embodiment 5 are the same as those of Embodiment 1, and will not be described here.

This embodiment provides a cleaning tool in which the blade can be effectively hidden to reduce the risk of wounding in the non-use state so as to make it convenient for carrying; and, the cleaning tool has a simple structure and a low production cost, and is simple to operate, easy to use, convenient for popularization and application in the market.

Embodiment 6

Figure 17:
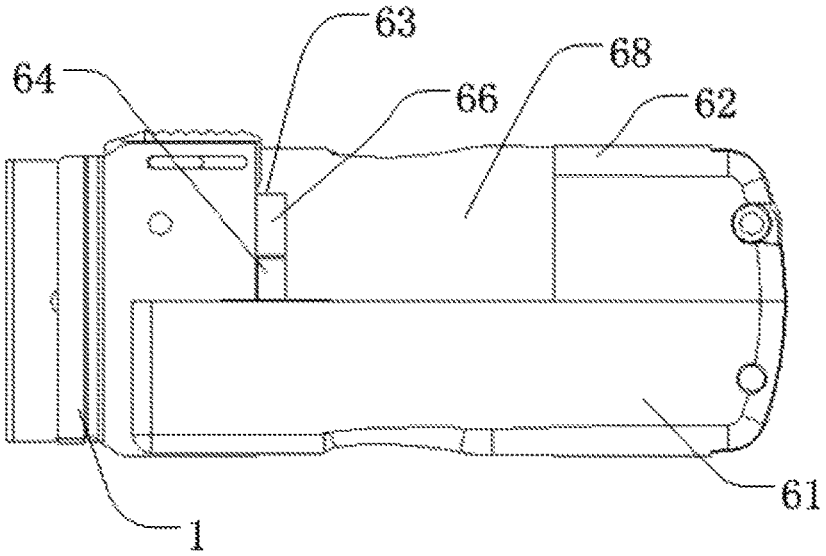
FIG. 17 is an overall structural schematic view of Embodiment 6 of the present invention in the use state.
Figure 18:
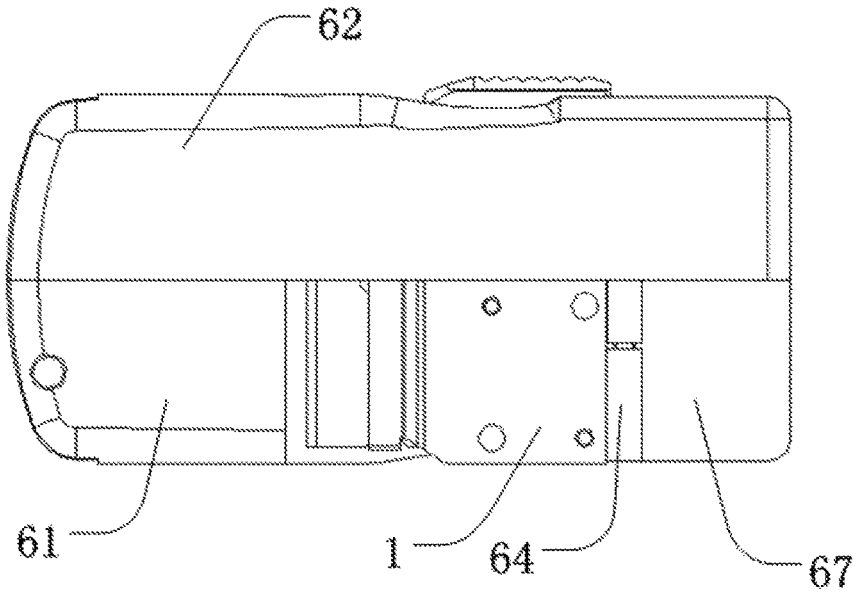
FIG. 18 is an overall structural schematic view of Embodiment 6 of the present invention in the non-use state.
Figure 19:
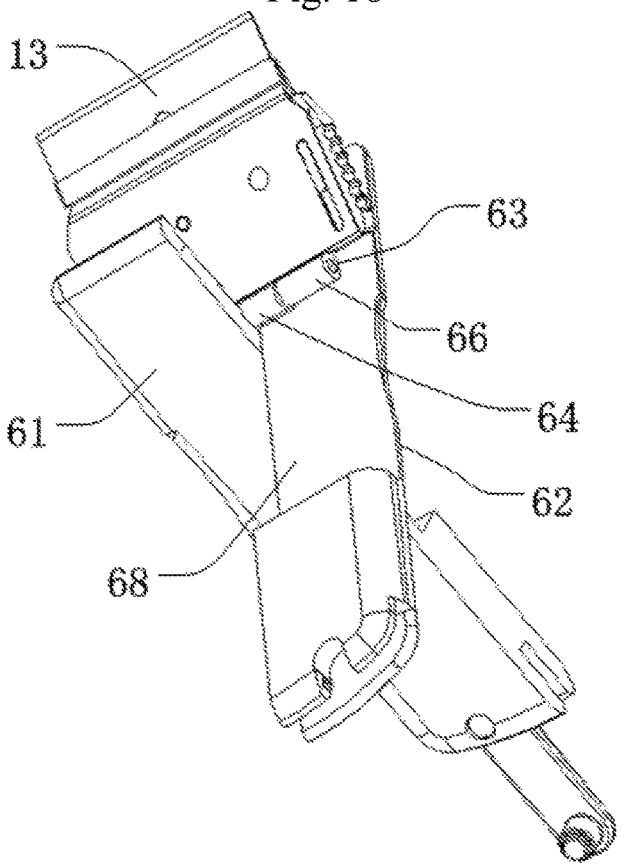
FIG. 19 is a structural schematic view of Embodiment 6 of the present invention during variation.

As shown in FIGS. 17 to 19, the technical features of Embodiment 6 are largely the same as those of Embodiment 5, and the distinguishing technical feature between them is in that the handle portion 11 includes a fourth handle 61, a fifth handle 62, a pivot shaft 63, a first sleeve 64, a second sleeve 65 and a third sleeve 66.

In this embodiment, one end of the fourth handle 61 is provided with a second receiving space 67, and the bottom of the second receiving space 67 is a sunken plane whose side wall is a portion of the fourth handle 61. One end of the fifth handle 62 is provided with a third receiving space 68, and the bottom of the third receiving space 68 is a sunken plane whose side wall is a portion of the fifth handle 62. A portion of the pivot shaft 63 is provided within the second receiving space 67 and the other portion thereof is provided within the third receiving space 68.

In this embodiment, the first sleeve 64 is rotatably sleeved outside the pivot shaft 63 and is connected to the tool head device 1, and specifically, the first sleeve 64 is connected to the edge of the spacer 114 in the tool post 11. The second sleeve 65 is rotatably sleeved outside the pivot shaft 63 and is connected to the fourth handle 61; and the third sleeve 66 is rotatably sleeved outside the pivot shaft 63 and is connected to the fifth handle 62. Since the second sleeve 65 and the first sleeve 64 can be relatively rotated by the pivot shaft 63, and the third sleeve 66 and the first sleeve 64 can be relatively rotated by the pivot shaft 63, the fourth handle 61 or the fifth handle 62 can be rotated relative to the tool post 11, and the rotation plane formed when rotated is perpendicular to the plane where the cutting edge 131 (blade 13) is located. The fourth handle 61 and the fifth handle 62 are disposed opposite and adjacently to each other, and can be rotated by 180 degrees relative to the plane where the blade 13 is located. The distal ends of the fourth handle 61 and the fifth handle 62 can be held in a straight line before and after the switching of the use state. The handle latching structure in this embodiment is provided at the distal ends of the two handles, and is the same as that of Embodiment 1, and will not be described here.

In the use state, the fourth handle 61 and the fifth handle 62 receive a portion of the tool post 11 within the second receiving space 67 and the third receiving space 68, the cutting edge 131 of the blade 13 is exposed outside of the two handles. In the non-use state, the fourth handle 61 and the fifth handle 62 are turned in the opposite direction by the user with both hands, and the cutting edge 131 of the blade 13 is received within the second receiving space 67 and the third receiving space 68 to reduce the risk of accidental wounding.

Other technical features of Embodiment 6 are the same as those of Embodiment 1 or 5, and will not be described here.

This embodiment provides a cleaning tool in which the blade can be effectively hidden to reduce the risk of wounding in the non-use state so as to make it convenient for carrying; and, the cleaning tool has a simple structure and a low production cost, and is simple to operate, easy to use, convenient for popularization and application in the market.

The preferred specific embodiments of the present invention have been described in detail above. It is to be understood that numerous modifications and variations can be made by those ordinary skilled in the art in accordance with the concepts of the present invention without any inventive effort. Hence, the technical solutions that can be derived by those skilled in the art according to the concepts of the present invention on the basis of the prior art through logical analysis, reasoning and limited experiments should be within the scope of protection defined by the claims.

The invention claimed is:

1. A cleaning tool, comprising:
a tool head device comprising a cutting edge; and
a handle portion rotatably connected to the tool head device;
the cutting edge is exposed outside of the handle portion in a use state;
the cutting edge is entirely or partially covered by the handle portion in a non-use state;
wherein the tool head device comprises:
a tool post;
a blade holder detachably fitted to the tool post; and
a blade fixed to the blade holder; the blade comprises the cutting edge;
wherein the tool post comprises two oppositely disposed clips, which are respectively:
a first clip; and
a second clip connected to the first clip;
a clip gap formed between the first clip and the second clip; the blade is provided in the upper portion of the clip gap, the cutting edge extends to the outside of the clip gap; the blade holder is provided in the middle portion of the clip gap; and
a spacer provided in a lower portion of the clip gap;
wherein
the tool post comprises two curved sheets, which are respectively:
a first curved sheet provided in the upper portion of the first clip and bent in the direction of the second clip; and
a second curved sheet provided in the upper portion of the second clip and bent in the direction of the first clip.

2. The cleaning tool according to claim 1, wherein the blade comprises a blade latch recess provided at the edges of both ends of the blade;
the tool post comprises:
a bending flap protruding from the edge of one end of one of the curved sheets and snapped into the blade latch recess; and/or
a toggleable flap protruding from the edge of one end of one of the curved sheets or one of the clips and snapped into the blade latch recess; and a clip opening is formed between the toggleable flap and the curved sheet or the clip.

3. The cleaning tool according to claim 1, wherein the tool post comprises:
a clip slide hole penetrating through one of the clips and adjacent to the edge of one end of the clip;
a spacer latch recess recessed from the side wall at one end of the spacer; and
a locking member, a portion of which is provided in the lower portion of the clip gap; the locking member comprises:
a locking member body tangent to the spacer;
a locking member slide block provided on the surface of one or both sides of the locking member body and inserted into the clip slide hole;
a locking member latch block protruding from one side wall of the locking member body and snapped into the spacer latch recess;
a locking member stop block protruding from a top portion of the locking member body;
the side of the locking member stop block is tangent to one end of the blade holder; and
a locking member push block protruding from the other side wall of the locking member body and exposed outside of the clip gap.

4. The cleaning tool according to claim 1, wherein the blade comprises:
a blade groove recessed from the surface of one side of the blade; or
a blade throughhole penetrating through the blade;
the tool post comprises:
a tool post latch block detachably snapped into the blade groove or the blade throughhole; the tool post latch block protruding from the surface of one of the curved sheets and facing toward another curved sheet.

5. The cleaning tool according to claim 1, wherein the tool post comprises:
a first clip throughhole penetrating through the first clip;
a second clip throughhole penetrating through the second clip; and
a spacer throughhole penetrating through the spacer.

6. The cleaning tool according to claim 1, wherein the tool post comprises:
a bump or a raised round face protruding from the outer surface of one of the clips and tangent to a partial surface of the handle portion.

7. The cleaning tool according to claim 1, wherein a rotation plane formed when the handle portion is rotated relative to the tool head device is the same as or parallel to a plane where the cutting edge is located.

8. The cleaning tool according to claim 7, wherein the handle portion comprises a handle, the handle comprises:
a first clamp provided on one end of the handle;
a second clamp provided on one end of the handle and disposed opposite to the first clamp; and
a first handle groove provided between the first clamp and the second clamp, the tool head device is entirely or partially rotatably fitted into the first handle groove.

9. The cleaning tool according to claim 8, wherein the handle portion comprises:
a first clamp throughhole penetrating through one end of the first clamp;
a second clamp throughhole penetrating through one end of the second clamp and disposed opposite to the first clamp throughhole; and
a pin shaft successively passing through the first clamp throughhole, the first clip throughhole, a spacer throughhole, the second clip throughhole and the second clamp throughhole.

10. The cleaning tool according to claim 8, wherein the handle portion comprises two handles, which are respectively a first handle and a second handle; each of the handles comprises:

a first gear teeth provided at the edge of one end of the first clamp; and a second gear teeth provided at the edge of one end of the second clamp;

wherein the first gear teeth of the first handle are engaged with the first gear teeth of the second handle; and the second gear teeth of the first handle are engaged with the second gear teeth of the second handle.

11. The cleaning tool according to claim 10, wherein the handle comprises:

a first arcuate plate provided at the edge of one end of the first clamp; and a second arcuate plate provided at the edge of one end of the second clamp.

12. The cleaning tool according to claim 7, wherein the handle portion comprises:

two handles, which are respectively a first handle and a second handle;

a second handle groove penetrating through the distal end of the first handle;

a third handle groove penetrating through the distal end of the second handle and being on the same straight line as the second handle groove;

a catch spindle having two ends vertically connected to two inner side walls of the second handle groove, respectively;

a locking opening penetrating through the side wall on one side of the third handle groove; and a handle catch having one end hinged to the catch spindle and the other end provided with a locking post; when the first handle and the second handle are brought into contact with each other, the locking post is snapped into the locking opening.

13. The cleaning tool according to claim 12, wherein the handle portion comprises a resilient latch sheet fixed within the second handle; the resilient latch sheet comprises a resilient bayonet corresponding to the locking opening; when the first handle and the second handle are brought into contact with each other, the locking post is snapped into the resilient bayonet.

14. The cleaning tool according to claim 1, wherein a rotation plane formed when the handle portion is rotated relative to the tool head device is perpendicular to a plane where the cutting edge is located.

15. The cleaning tool according to claim 14, wherein the handle portion comprises:

a pivot shaft;

a first sleeve rotatably sleeved outside the pivot shaft and connected to the tool head device; and a second sleeve rotatably sleeved outside the pivot shaft and connected to one of the handles.

16. The cleaning tool according to claim 15, wherein the handle portion comprises a third sleeve rotatably sleeved outside the pivot shaft and connected to the other handle.

17. The cleaning tool according to claim 15, wherein the handle portion comprises:

two handle throughholes penetrating through the handle, which are respectively on both sides of the pivot shaft; and a bolt for fixing the tool head device and the handle portion;

the bolt successively passes through the handle throughhole, the second clip throughhole, a spacer throughhole and the first clip throughhole in the use state; and the bolt successively passes through the handle throughhole, the first clip throughhole, the spacer throughhole, and the second clip throughhole in the non-use state.

* * * * *